US005564856A

United States Patent [19]

Modrak

[11] Patent Number: 5,564,856

[45] Date of Patent: Oct. 15, 1996

[54] HOT-MIX COMPOSITIONS FOR MAKING AND REPAIRING GEOWAYS CONTAINING POLYOLEFIN-POLYARYLATE ALLOY FIBERS

[75] Inventor: James P. Modrak, Conyers, Ga.

[73] Assignee: Hercules Incorporated, Wilmington, Del.

[21] Appl. No.: 471,818

[22] Filed: Jun. 6, 1995

Related U.S. Application Data

[62] Division of Ser. No. 285,559, Aug. 3, 1994, Pat. No. 5,502,160.

[51] Int. Cl.[6] ..... E01C 7/22; E01C 7/26

[52] U.S. Cl. ..... 404/75; 106/282; 405/79; 524/59

[58] Field of Search ..... 404/31, 32, 75, 404/79; 106/281.1, 282; 524/59

[56] References Cited

U.S. PATENT DOCUMENTS

| | | | |
|---|---|---|---|
| 3,639,505 | 2/1972 | Hughes et al. | 525/177 |
| 4,368,295 | 1/1983 | Newton et al. | 525/177 |
| 4,414,276 | 11/1983 | Kiriyama | 428/374 |
| 4,422,878 | 12/1983 | Fry | 106/282 X |
| 4,492,781 | 1/1985 | Duszak et al. | 524/59 |
| 4,502,814 | 3/1985 | Trimble | 404/107 |
| 4,510,743 | 4/1985 | de Kroon . | |
| 4,708,985 | 11/1987 | Diamantoglou et al. | 525/166 |
| 4,837,387 | 6/1989 | van de Pol . | |
| 4,908,052 | 3/1990 | Largman et al. | 525/177 |
| 4,963,430 | 10/1990 | Kish et al. | 525/166 |
| 4,981,896 | 1/1991 | Okada et al. | 524/413 |
| 5,004,782 | 4/1991 | Mashita et al. | 525/64 |
| 5,026,609 | 6/1991 | Jacob et al. | 404/31 X |
| 5,093,404 | 3/1992 | Okada et al. | 524/413 |
| 5,281,668 | 1/1994 | Heggs et al. | 525/166 |
| 5,364,694 | 11/1994 | Okada et al. . | |

FOREIGN PATENT DOCUMENTS 0494326 7/1992 European Pat. Off. .

OTHER PUBLICATIONS

*Hawley's Condensed Chemical Dictionary,* Van Nostrand Reinhold Company, Twelfth Edition, 1993, p. 100.

H. R. Spreeuwers et al., "AP–28: A Polymer Blend of . . . " Polypropylene Fibres and Textiles IV, Fourth International Conference on Polypropylene Fibres and Textils, Univ. of Nottingham, 23–25 Sep. 1987.

*Primary Examiner*—George A. Suchfield

*Attorney, Agent, or Firm*—Mark D. Kuller; Bradley N. Ruben

[57] ABSTRACT

The invention provides melt-spun polyolefin/polyarylate alloy fibers having an elevated softening point. These fibers are useful in staple lengths for the reinforcement of synthetic geoways (e.g., roadways, runways), especially those fabricated from asphalt-based pavements. The improved softening point of the fibers allows their incorporation into the hot-mix pavement used to fabricate and repair such surfaces without degradation of the fibers by the elevated temperatures found in plants for these manufacture of hot-mix pavements. This invention also provides an improved process for making melts of such allows.

31 Claims, No Drawings

HOT-MIX COMPOSITIONS FOR MAKING AND REPAIRING GEOWAYS CONTAINING POLYOLEFIN-POLYARYLATE ALLOY FIBERS

This application is a division of application Ser. No. 08/285,559, filed Aug. 3, 1994, now U.S. Pat. No. 5,502,160.

BACKGROUND OF THE INVENTION

1. The Field of the Invention

The present invention pertains to fibers comprising an alloy of a polyolefin and a polyarylate that have improved softening characteristics, to making and using hot-mix pavements containing such fibers for paving and repairing geoways (e.g., roadways and runways), and to the geoway structures so made and repaired.

2. The State of the Art.

In the paving and repairing of synthetic load-bearing vehicular geoways, such as roadways, aircraft and aeronautic takeoff/landing runways and launch pads, and similar surfaces, an asphalt cement (i.e., pure asphalt) is typically used as a base material. Asphalt cement is comprised of asphalt and/or bitumen combined with flux oil (i.e., oil obtained from asphalt-base petroleum, typically 20°–25° B é). The asphalt cement is typically mixed with coarse graded mineral aggregate, such as broken stone, slag, or gravel mixed with sand, to produce an asphalt concrete used as the commonly recognized roadway surface. Asphalt-type cement compositions typically contain asphalt cement, rubber, or mixtures of asphalt cement with rubber and/or acrylic copolymers, and asphalt-type concrete compositions contain an asphalt-type cement and aggregate materials. The super-ambient softening temperature of the asphalt cement in the asphalt concrete requires that the concrete be processed to an elevated temperature to allow its flowable application to the surface being paved or repaired.

Polymeric fibers have been used, among other applications, for the reinforcement of engineering compositions having a variety of utilities. Asphalt-type pavements frequently contain synthetic polymeric staple fibers to improve flexibility and durability of the pavement. For instance, Duszak et al., in U.S. Pat. No. 4,492,781 (the disclosure of which is incorporated herein by reference), describe a fiber-reinforced asphalt-type pavement comprising an emulsifying agent, a water-soluble polymer, and 0.25% to 10% of reinforcing fibers, such as polyethylene or polypropylene staple fiber about 0.1 to 20 mm long, as well as conventional aggregate and thickening and curing agents, for application to surfaces as a hot mixture or as an emulsion. Either hot-mix or emulsified asphalt-type pavements may be applied as a filler for underlying cracks in the surface as a waterproof layer between old and new pavements, or as an external surfacing material. Those different functions involve differences in the amount and fineness of aggregate, the concentration and length of the reinforcing fibers, and the use of different and various conventional additives.

Synthetic staple fibers such as polypropylene and polyethylene fibers are desirable because they are compatible with asphalt-type pavements. The longer lengths and higher concentrations of reinforcing fibers that facilitate interconnections between the fiber and the asphalt matrix, and an increase in durability, nevertheless adversely effect the pumpability (flowability) of the pavement and tend to produce clumping of the fibers. The addition of reinforcing fibers also requires a higher processing temperature range than the conventional 140°–150° C. (284°–302° F.) range for convenient hot application.

Fry, in U.S. Pat. No. 4,422,878 (the disclosure of which is incorporated herein by reference), describes asphalt-type pavements containing about 4–10 wt. % of a fibrous filler, about 2.5 to 15 wt. % of a mixture of eighteen-carbon fatty acids, and up to about 30 wt. % rosin.

Leibee et al., in U.S. Pat. No. 4,662,759, and Trimble, in U.S. Pat. No. 4,502,814 (the disclosures of which are incorporated herein by reference), respectively disclose devices useful for admixing reinforcing fibers into an asphalt-type pavement and for the continuous deposition of a fiber- and asphalt-containing pavement.

Modrak, in European Patent Appln. No. 494,326 (the disclosure of which is incorporated herein by reference), describes fiber-reinforced asphalt pavements characterized in that the reinforcing fibers are bicomponent fibers comprising a polyolefin-containing bonding component conjugated with a polyolefin-wettable reinforcing component.

Spreeuwers, H. R., and G. M. W. van de Pol, in "AP-28: A Polymer Blend of Polypropylene and Polyethylene Terephthalate that Offends the Rules" (Polypropylene Fibres and Textiles IV, Fourth International Conf. on Polypropylene Fibres and Textiles, Univ. of Nottingham, 23–25 Sept. 1987), describe fibers derived from films that comprise 80 wt. % polypropylene and 20 wt. % polyethylene terephthalate (PET). These fibers have an elevated melting point by virtue of particular processing conditions; the melting point of pure polypropylene processed under these conditions increased from 162° C. to 168° C., and to 173° C. with the addition of 20% PET.

In U.S. Pat. No. 4,837,387, van de Pol describes a supporting geotextile fabric for bearing bulk material. The fabrics are made from tape or thread yarns (which van de Pol teaches are described in GB 1,559,056) comprised of 75–85% polypropylene and 25–15% polyester (such as PET). Fibrillated yarns and non-fibrillated tape yarns are significantly different from yarns derived from spun fibers. Yarns produced from films or tapes will have at least two flat surfaces, whereas generally a spun fiber is made with a circular or arcuate cross-section. Additionally, fibers made by splitting a film have a non-uniform cross-section (i.e., a non-uniform width), and thus a non-uniform denier. Further, the denier of such fibers is on the order of 200±50 dpf and the fiber has an extremely high surface area. Even further, the surface along which fibrillation is effected is relatively rough, causing the fibers to entangle and clump, a problem which renders the fibers unsuitable for dispersing in a hot-mix pavement.

There is a need for fiber-reinforced asphalt-type pavements that facilitate the reinforcing integrity of the fibers at the elevated processing temperatures required for application of a hot-mix pavement. There is a need to enhance the fiber integrity and improve durability, flexibility, and shear resistance of the pavement without resorting to increasing the staple length or the concentration of staple fiber. There is also a need for a hot-mix pavement with polymeric reinforcing fibers that can be processed under a wide range of temperature conditions.

SUMMARY OF THE INVENTION

Among the beneficial objects achieved by this invention are the creation of a material useful for reinforcing asphalt vehicular geoways, providing a geoway less easily damaged by use and weathering and requiring less frequent repair, providing a pavement useful in the production of such surfaces, and providing a pavement useful in the repair of geoways of a variety of compositions.

In summary, the present invention provides: a melt-spun fiber comprising an alloy of (i) a polyolefin comprising polyethylene or polypropylene and (ii) a polyarylate, wherein the polyarylate is present in an amount effective to increase the softening temperature of the fiber; a hot-mix pavement comprising both asphalt and the novel melt-spun fiber present as a staple fiber; an improved geoway formed using the hot-mix pavement; and methods of making and of repairing geoways using the novel hot-mix pavement. The invention also provides a method of using the novel fibers in the production and repair of geoways, and a method of producing and repairing geoways.

In another aspect, the invention provides a method for making an alloy composition comprising (i) polyethylene or polypropylene and (ii) a polyarylate, especially poly(ethylene terephthalate), by providing each of the polymers in particulate form, preferably using scrap material for one or both of the polymers, heating the polyarylate particles to drive off water, and then admixing the particulate polyolefin before continuing the conventional heating and mixing to make the alloy composition. These staple fibers are useful for reinforcing pavement.

DETAILED DESCRIPTION OF PARTICULAR EMBODIMENTS

As used herein, an "alloy" is a blend or mixture of the polymeric compositions. Accordingly, to maintain the homogeneity of the alloy, the polyolefin(s) and the polyarylate(s) should have a degree of compatibility with each other. Likewise, alloys useful in this invention are melt-spinnable.

As used herein, "geoway" is a synthetic surface designed to support land or air vehicles, and includes such surfaces as roadways, runways, launch pads, heliports, and their associated support surfaces (e.g., taxiways, hanger bay floors, etc.). It might be noted that each of these geoways has a different design criteria; for example, launch pads must withstand extreme temperatures, and runways generally bear greater loads than roadways.

Also as used herein for ease of disclosure, an "asphalt" pavement refers to the composition of the base materials mentioned above which are suitable for pavement, such as asphalt cement, rubber, or mixtures of asphalt cement with rubber and/or acrylic copolymers, or to a concrete having aggregate materials (as the context warrants), and further includes pavements having no asphalt present, such as cement concrete (e.g., a mixture of Portland cement and aggregate material); "pavement" ordinarily denotes either an artificial surface (such as a geoway) or the composition used for making such a surface, as the context warrants.

The invention involves a novel fiber having at least two components, a polyolefin and polyarylate, wherein the polyarylate is present in an amount effective to increase the softening point of the fiber. Polyolefin fibers can be used to reinforce hot-mix pavements for roadways, but are subject to significant degradation because the hot-mix processing temperatures are on the order of the softening point of polyolefins (about 150° C. for polypropylene). The novel fibers of this invention have an increased softening point and degrade and shrink less than fibers conventionally used during the production and use of a hot-mix pavement. The greater integrity of the fiber in resisting the elevated temperature used for processing of the hot-mix pavement yields longer, higher strength fibers in the final composition, and thus a tougher geoway surface.

The fibers are formed from an alloy of a polyolefin and a polyarylate, wherein the polyarylate is present in an amount sufficient to increase the softening point of the fiber. The "softening point" is essentially the crystalline melting temperature of the material. Preferably the alloy comprises polyethylene, polypropylene, or a copolymer thereof as a component of the polyolefin portion of the alloy. Polyethylene, polypropylene, and their copolymers, in addition to ethylene-propylene copolymers, often contain units derived from one or more monomers selected from among 1-butene, 2-butene, 1,3-butadiene, and the like. These comonomers are present in an amount up to about 10 wt. %. Typically, a "polypropylene" or "polyethylene" fiber may have such minor amounts of one or more comonomers (e.g., a fiber having 95% propylene units and 5% ethylene units). The polyolefin portion may also contain a compatible mixture of different polyolefins. When polypropylene is used, it may have a viscosity average molecular weight of about 140,000 to 280,000, or even higher. The polyarylate portion of the alloy preferably comprises an aromatic moiety in its backbone to provide improved heat stability. Suitable polyarylates include polyesters such as poly(ethylene terephthalate) (hereinafter "PET"), polyphenylsulfones, and the like. The polyolefin and the polyarylate are preferably compatible with each other (and any other polymeric or additive compositions present) in the alloy at all temperatures required for their fabrication into fibers and their use in the production of a geoway.

The polyarylate is preferably present in the alloy in amounts effective to increase the softening point of the fiber. Most preferably the polyarylate is present in amounts which are both compatible with the polyolefin and which provide an increased softening point during both fiber formation and geoway production or repair. Preferred alloy fibers comprise 98–50 wt. % polypropylene (hereinafter "PP") and 2–45 wt. % PET (all percentages are based on weight unless otherwise specified), more preferably 87–73% PP and 13–27% PET, and most preferably 82–78% PP and 18–22% PET. Other preferred compositions include as additional constituents of the polyolefin portion of the alloy a styrene- and/or maleic acid-modified polyolefin; the addition of these types of polymers to a PP/PET alloy improves the compatibility between the PP and the PET; similar compatibility-enhancing polymers can be used with other polyolefin/polyarylate combinations. These modified polymers are made by known techniques wherein styrene, maleic acid, maleic anhydride, or a similar material is grafted onto the backbone of the polymer using a free radical catalyst.

The polyolefin and the polyarylate are formed into a fiber, preferably by melt-spinning, and are drawn to provide a high degree of orientation. The fibers are preferably spun to a denier of 10–100 dpf, more preferably 10–30 dpf, and most preferably 15–20 dpf, and thereafter heated and drawn to a final denier of 1–30 dpf, more preferably 3–15 dpf; preferably, the fiber finally used in the hot-mix pavement will have a diameter of 0.254–0.270 mm (1–5 mil). Drawing can be done cold or hot. Cold drawing occurs when the fiber "chalks" or develops an opacity (color change) due to the formation of microvoids from the drawing, whereas there is no "chalking" of the fiber when hot drawing is performed; hot drawing of PP/PET fibers is generally conducted at a temperature of at least about 75° C., more preferably at least about 85° C., and most preferably at about 100° C. The continuous length spun fibers (i.e., filaments) are chopped into staple lengths, preferably on the order of 5–25 mm long, for use in the production and repair of geoways. Preferably these fibers have a generally arcuate cross-section, and most preferably are essentially circular in cross-section.

Various surface coatings or finishes are applied to the fibers after spinning to facilitate handling the fibers for further processing. In the practice of this invention, any finish that does not degrade the compatibility of the fiber with respect to the pavement may be used. A preferred finish is one having antistatic properties to prevent excess static charge build-up due to contact of the fiber with metal and other surfaces to produce the final fiber produce, and to avoid static charge accumulation when the fiber is used by the customer. Suitable finishes are described by Schmalz in U.S. Pat. No. 4,938,832 and EP 0 486 158 A2 (corresponding to U.S. patent application Ser. No. 914,213, filed Jul. 15, 1992, now abandoned) (the disclosures of which are incorporated herein by reference), in which the finish is a blend of compositions comprising at least one amine or alkali metal neutralized phosphoric acid alkyl ester (an antistatic component) and a siloxane lubricant. Another suitable finish is described by Harrington, in EP 0 557 024 A1 (the disclosure of which is incorporated herein by reference), as comprising at least one neutralized $C_3$–$C_{12}$ alkyl or alkenyl phosphate alkali metal or alkali earth metal salt and a solubilizer, or a neutralized phosphoric ester salt having the general formula $(MO)_x$-(PO)-$(O(R_1)_nR)_y$ wherein generally M is an alkali or alkali earth metal, $R_1$ is a short chain alkylene oxide, R is a long chain alkyl or alkenyl group, and x and y are natural numbers having the sum of 3; the solubilizer can be selected from among glycols, polyglycols, glycol ethers, and the aforementioned neutralized phosphoric ester salts. Yet another suitable finish is described by Johnson and Theyson, in U.S. patent application Ser. No. 08/115,374, filed Sep. 2nd, 1993, now U.S. Pat. No. 5,403,426, and in European Patent Appln. No. 0 516 412 (the disclosures of which are incorporated herein by reference), as comprising a polyol or a derivative thereof formed by reacting the polyol with a fatty acid or a short chain alkylene oxide, and an antistatic finish comprising an amine or alkali metal neutralized phosphoric acid ester of the general formula $(MO)_x$-(PO)-$(OR)_y$ wherein M is an amine or alkali metal, R is an alkyl group, and x and y are natural numbers having the sum of 3; the fibers may also have an overfinish comprising a polysiloxane (lubricant) and the antistatic finish just mentioned. One preferred composition is a neutralized phosphoric acid ester (designated LUROL® AS-Y, available from George A. Goulston, Co., Monroe, N.C.). It is also preferred that a finish be used that provides lubrication. Preferred lubricants are esters of polyoxyalkylene glycols and mixed dibasic acids, such as described in U.S. Pat. Nos. 3,925,589 and 3,959,187 (the disclosures of which are incorporated herein by reference); for example, an oleophilic polyoxyalkylene mixed dibasic acid ester finish available as "EMERLUBE 7485B" (from Henkel Corp., Ambler, Pa.), which also contains an amine-neutralized phosphate ester antistatic agent. A particularly preferred finish includes a mixture of a neutralized phosphate ester and an oleophilic polyoxyalkylene mixed dibasic acid ester; for example, a mixture of the "EMERLUBE 7485B" and the "LUROL® AS-Y". Other suitable fiber finishes with lubricating properties are described in the aforementioned Schmalz, Harrington, and Johnson and Theyson patents and applications. Yet another finish is a mixture of polyethylene glycol 400 monolaurate and polyoxyethylene(5)tridecylphosphate neutralized with diethanolamine (available as "LUROL PP-912" from George A. Goulston Co., Monroe, N.C.). When the fibers are to be gas-fluidized and conveyed to a pavement mixing device, it is preferred to use a finish having antistatic properties in an amount sufficient to prevent the build-up of static charge, such that the fiber with the finish on its surface is suitable for reinforcing pavement. A particular finish may be applied one or more times at various points in the process of making staple fibers, and is preferably applied as a spin finish.

The hot-mix pavement may include one or more conventional additives, such as one or more water-soluble polymers selected from among carboxymethyl cellulose, its sodium or calcium salt, carboxymethyl hydroxyethyl cellulose, hydroxypropyl hydroxymethyl cellulose, and the like, and mixtures thereof, as described in the aforementioned Duszak et al. patent.

A separate aspect of this invention is a novel method for making a polyolefin-polyarylate alloy composition. It is an environmentally beneficial aspect in making reinforcing staple fibers to use scrap and/or recycled materials. Scrap PET, available as recycled consumer packaging typically collected in the form of soda bottles, can be used as the polyarylate component of the alloy. Scrap PET is typically available in commerce as rectangular chunks of PET film. PP is typically available in particulate form as spheres, pellets, or thin flakes. The characteristics of the scrap PET tend to allow the chunks to slide together and aggregate when conventionally mixed with PP flake; such an aggregation can lead to PET slugs in the melt and an inhomogeneous alloy. We have discovered that this problem can be avoided by first heating the scrap PET chunks to drive off any water (e.g., $T \geqq 100°$ C. at atmospheric pressure), and, while the PET chunks remain at an elevated temperature, admixing the PP particles. This processing technique and order of addition tends to coat the PET chunks with the PP particles and prevent their agglomeration. PP from scrap material can also be used.

Asphalt concrete, as described in the Background section, is comprised generally of asphalt cement and a non-reactive aggregate. The asphalt cement and the aggregate are mixed at temperatures on the order of 150°–165°C. (300°–330° F.), a temperature sufficiently elevated that the asphalt cement liquifies and can be mixed with the aggregate to provide a heated slurry referred to as a "hot-mix". Other examples of suitable pavements include cured latex materials combined with 99–70 wt. % asphalt cement, ethylene/acrylic acid copolymers combined with 90–75 wt. % asphalt cement, as well as asphalt-to-latex copolymers of styrene and butyl acrylate (e.g., as commercially available from Rohm & Haas Co., Philadelphia, Pa., under the trademark "EL 805"), used alone or in combination with hydrogenated rosin esters (e.g., as commercially available from Hercules Incorporated, Wilmington, Del., under the trademark "FORAL® 85").

The staple fibers are added to the hot-mix and the composition is applied to produce a geoway. Although the processing temperature of the hot-mix may be less than the theoretical softening point of the pure polyolefin, in actual processing conditions the temperature is frequently greater than this temperature. Additionally, in certain situations, it is necessary to produce the hot-mix, transfer the heated hot-mix to an insulated carrier, and transport the hot material to a remote destination. Accordingly, in these situations the hot-mix is provided in a very hot state to compensate for heat losses during transportation. Typically, this "long haul" of hot material is practiced during the colder months. The staple polyolefin/polyarylate fibers are added to the hot-mix at levels of 0.01–5% (e.g., 0.1–50 kg. per metric ton of hot-mix), more preferably 0.05–1%, and most preferably 0.1–0.5% of the hot-mix pavement.

As the staple fibers are blended into the hot-mix pavement, they are heated at times greater than the-average temperature of the hot-mix. Temperatures varying on the order of 160° C. (the melting point of pure polypropylene) in various portions of the composition (i.e., "hot spots") would cause drawn pure polypropylene fibers to shrink. The reinforcement provided to a material by the incorporation of fibers is proportional to the aspect ratio of the fiber used (i.e., the ratio of the length of the fiber to its diameter); thus, as the fibers shrink they provide less reinforcement. The fibers of the present invention are sufficiently heat resistant in the hot-mix composition that they resist shrinkage and maintain their reinforcing aspect.

The resulting hot-mix pavement can be applied directly to a prepared surface to fabricate an entire geoway, such as a roadway, using conventional techniques and apparatus. This improved hot-mix pavementis especially useful in repairing defects (e.g., pot-holes) in asphalt geoways. This composition can also be used for the repair of defects in geoways comprised of other materials, such as cement concrete, although such repairs are typically temporary until a repair with the original type of material can be made.

It is preferred to that the fibers have a "Asphalt Adhesion Test" value that is at least about 35. The Asphalt Adhesion Test measures the weight of asphalt (or other cement used for the pavement) that adheres to a given weight of fiber; thus, a value of 35 g. of asphalt per gram of fiber is preferred for conventional asphaltic hot-mix pavements. Using asphalt meeting state or AASHTO (American Association of State Highway Transportation Officials) specifications, the Asphalt Adhesion test is conducted by taking a tow or bundle having about 300 filaments of 4 dpf fiber and cutting the tow into a bundlette of staple fibers having a lengths of 4¼ inches. The bundlette weight is adjusted by adding to or from the bundlette staple fibers until the bundlette weight is 0.012 g.±0.002 g. The bundlette is clipped (e.g., using a lab clip or by taping to a paper clip) at a distance of 4 in. so that the individual staple fibers resemble the fibers of a paint brush. Asphalt is heated in a covered container to 280° F., the cover is removed, and the fibers (with the clip) are pushed into the hot asphalt; the fibers tend to float on the liquid asphalt and so must be forcibly immersed and agitated gently to make sure the asphalt coats the fibers. After five (5) seconds of immersion, the sample is removed and, while support the clip so the fibers hang vertically, the fibers are allowed to cool to room temperature. The fibers are cut from the clip at the 4 in. length and weighed. The difference between starting weight and final coated weight is recorded. The test is repeated using four additional fiber samples and is precise when the standard deviation is not more than 5% of the average weight of the asphalt cement on the samples.

The invention will now be further described with reference to the following examples, which are meant to further illustrate the invention without limitation to the particular materials and conditions described.

EXAMPLES 1–4

Three sets of fibers of polypropylene fibers were melt-spun with PET present in the melt in amounts of zero, 5%, and 20% by weight of the melt composition. The fibers were spun and drawn to a final denier of 4 dpf. The fibers having a 5% addition of PET were cold drawn at ambient temperature or were hot drawn at a temperature of 135° C. The fibers were cut into staple fibers and then tested for shrinking/softening points and melting points, the results of which are shown in Table 1.

TABLE 1

| Example | % PET | Draw | Shrink/ Softening Temp. (°C.) | Melting Temp. (°C.) |
|---|---|---|---|---|
| 1 | 0 | none (as spun) | 156–159 | 165 |
| 2 | 5 | cold | 162.5 | 165 |
| 3 | 5 | hot | 160 | 165 |
| 4 | 20 | none (as spun) | 168 | >168 |

Assuming the softening point of pure polypropylene fibers to be 160° C., it can be seen from Table 1 that the present invention provides increases of 1.5% and 5% in the softening point with the addition of 5% and 20% of a polyarylate.

EXAMPLES 5–6

Fibers were produced generally as described in Example 4, comprising 20% PET and 80% PP, and then cold drawn at ambient temperature or were hot drawn at 100° C. The fibers were then tested for shrinking and melting temperatures, the results of which are shown in Table 2.

TABLE 2

| Example | % PET | Draw | Shrink/- Softening Temp. (°C.) | Melting Temp. (°C.) |
|---|---|---|---|---|
| 5 | 20 | cold | 164 | 168 |
| 6 | 20 | hot | 162.5 | 165 |

EXAMPLES 7–9

Fibers corresponding to those fabricated as described in Examples 1, 5, and 6 were made and placed in a hot air oven; their shrinkage and/or melting behavior was observed and recorded as shown in Table 3. The fibers were first placed for 30 minutes into an oven maintained at 155° C. Thereafter, the oven temperature was raised to 158° C. and the fibers were left for a period of five (5) minutes.

TABLE 3

| Example | % PET | Draw | Behavior at 155° | Behavior at 158° |
|---|---|---|---|---|
| 7 | 0 | none | fused and shrunk | fused and shrunk |
| 8 | 20 | cold | no fusion<br>some softening | some fusion<br>minimal shrinkage |
| 9 | 20 | hot | no fusion<br>some softening | negligible fusion<br>stiffer |

As used in Table 3, the fiber exhibited fusion when it bonded to another fiber with which it was in contact, and the fiber exhibited shrinkage when it was observed that the fiber's curvature or its aspect ratio changed from that originally present.

EXAMPLE 10

Fibers were spun from a melt comprising 20% PET derived from scrap soft drink bottles, 1% of a maleic acid-modified PP (available as "UNITE 620" polymer from Aristech (Pittsburgh, Pa.), and 79% PP, and then hot drawn to a final denier of 4 dpf, and cut into staple fibers. These staple fibers exhibited a shrinkage/softening point of 168° C. and a melting point of greater than 200° C.; the fibers remarkably exhibited some shape retention even up to 256° C. (i.e., the fibers did not coalesce into a melted puddle). Thus, these fibers provided an increase in the melting point of at least 25%.

EXAMPLES 11 AND 12

Staple fibers of 3/8 inch lengths were provided from pure polypropylene fibers as described in Example 1 (Example 11) and as described in Example 10 from a blend of PP, PET, and maleic acid-modified PP (Example 12). Samples of each of these staple fiber types were placed into an oven and their heat resistance characteristics were observed and recorded as shown in Table 4 as the temperature was raised.

TABLE 4

| Temperature (°C.) | Example 11 | Example 12 |
|---|---|---|
| 138 | no change | no change |
| 147 | slight wavy appearance | slight wavy appearance |
| 150 | slight wavy appearance | slight wavy appearance |
| 157 | fibers shrunk to 11/32 inch length | slight wavy appearance |
| 161 | fibers shrunk to 5/16 inch length | fibers shrunk to 11/32 inch length |
| 166 | fibers 5/16 inch length; matted, partly melted, especially on ends with globs | fibers 5/16 inch length; partly melted, and a few globs on ends |
| 168 | completely melted | mostly melted with a few fibers surviving |

EXAMPLE 13–17

Fibers were spun from a melt of an alloy comprising about 20% PET scrap from soda bottles, 1% maleic acid-modified PP ("UNITE 620" polymer), and 79% PP flake, drawn to a final denier of 4 dpf, and cut into 10 mm staple fibers. A mixed finish containing 9 parts by weight of an oleophilic polyoxyalkylene mixed dibasic acid ester finish ("EMERLUBE 7485B") to 1 part by weight of an antistatic finish ("LUROL® AS-Y") was applied as a spin finish to provide about 0.75 wt. % (fiber weight basis) of mixed finish on the fibers.

A standard hot mix composition was prepared in a 5-ton batch hot mix plant in Lexington, Ky., under KYDOT (Commonwealth of Kentucky, Department of Transportation) standards. Hot-mix batches containing 5.6–5.7 wt. % asphalt and graded stone were prepared using the same average stone grade for each. In some batches, the staple fibers were added in an amount of about six (6) pounds per ton of hot mix. A commercially available PET fiber for use in hot mix compositions was also tested for comparison. Various samples of these mixes were evaluated by the KYDOT for Marshall Stability with the results shown in Table 5. Marshall Stability is generally determined by compacting a sample of hot-mix using a predetermined number of blows into a test piece of a particular geometry and then testing for deformation under elevated temperatures (140° F., simulating roadway conditions on a hot day); higher Marshall values indicate increased stability. A void content of 3–6% is generally considered acceptable for roadways.

TABLE 5

| Example | 13 (Control) | 14 | 15 | 16 | 17 |
|---|---|---|---|---|---|
| Reinforcement | none | PP/PET alloy | PP/PET alloy | PET | PP |
| Hot Mix Temp. (°F.) | 325 | 315 | 305 | 345 | 285 |
| Blow Compaction | 50 | 50 | 75 | 50 | 50 |
| Sp. Grav. | 2.339 | 2.376 | 2.328 | 2.310 | 2.354 |
| % Air Voids | 5.95 | 3.96 | 5.5 | 6.6 | 5.0 |
| Marshall (meas.) | 1675 | 1967 | 2013 | 1633 | 1700 |
| Marshall (adj.) | 1642 | 1980 | 1957 | 1568 | 1683 |

These examples show that the fibers of this invention survive the elevated temperatures on the order of 300°–320° F. found in typical asphalt hot-mix plants. Further, the Marshall Stability values indicate that the use of the present fibers produces a pavement having a higher strength and a higher toughness than presently achieved with pavements reinforced with either polypropylene or PET fibers.

The present invention has been described with reference to the foregoing embodiments and examples without being limited by the particular content thereof, and various additions, substitutions, deletions, and other modifications thereof are intended to be within the scope and spirit of the invention as defined by the following claims.

What is claimed is:

1. A fiber-reinforced pavement, comprising: a hot-mix pavement and staple fibers comprising an alloy of (i) a polyolefin selected from the group consisting of polyethylene, polypropylene, and copolymers thereof and (ii) a polyarylate.

2. The pavement defined by claim 1, wherein the pavement is a concrete further comprising an aggregate material.

3. The pavement defined by claim 1, comprising 0.01–5 wt. % of fiber.

4. The pavement defined by claim 1, wherein the polyolefin is polypropylene.

5. The pavement defined by claim 1, wherein the polyarylate is poly(ethylene terephthalate).

6. The pavement defined by claim 3, wherein the polyolefin is polypropylene (PP), the polyarylate is poly(ethylene terephthalate) (PET), and the fiber comprises 98–50 wt. % PP and 2–45 wt. % PET.

7. A method of repairing a geoway having a defect therein, comprising:

providing a pavement as defined by claim 1; and applying said pavement to said geoway to repair said defect.

8. A method of producing a geoway, comprising:

providing a pavement as defined by claim 1;

providing a surface for the application of said pavement; and applying said pavement to said surface to produce a geoway.

9. A geoway, produced by the process defined by claim 8.

10. The geoway defined by claim 9 in the form of a roadway.

11. The geoway defined by claim 9 in the form of a runway.

12. The pavement defined by claim 3 wherein the polyolefin is polypropylene (PP), the polyarylate is poly(ethylene terephthalate) (PET), and the fiber comprises 98–73 wt. % PP and 2–27 wt. % PET.

13. The pavement defined by claim 3 wherein the polyolefin is polypropylene (PP), the polyarylate is poly(ethylene terephthalate) (PET), and the fiber comprises 87–73 wt. % PP and 13–27 wt. % PET.

14. The pavement defined by claim 3 wherein the polyolefin is polypropylene (PP), the polyarylate is poly(ethylene terephthalate) (PET), and the fiber comprises 82–78 wt. % PP and 18–22 wt. % PET.

15. The pavement of claim 1 wherein the fiber has a softening temperature of at least 160° C.

16. The pavement of claim 1 wherein the fiber has a softening temperature of at least 162.5° C.

17. The pavement of claim 1 wherein the fiber has a softening temperature of at least 164° C.

18. The pavement of claim 3 wherein the fiber has a softening temperature of 160°–164° C.

19. The pavement of claim 12 wherein the fiber has a softening temperature of 160°–164° C.

20. The pavement of claim 1 wherein the polypropylene is a copolymer comprising up to 10 wt. % of monomeric units selected from the group consisting of ethylene, 1-butene, 2-butene, 1,3-butadiene, and mixtures thereof.

21. The pavement of claim 1 wherein at least a portion of said polyolefin is modified with styrene, maleic acid, maleic anhydride, or a mixture thereof.

22. The pavement of claim 1 wherein the polyolefin comprises a mixture of polypropylene and maleic acid-modified polypropylene.

23. The pavement of claim 1, wherein the polyolefin includes a polyethylene homopolymer or a polyethylene copolymer comprising up to 10 wt. % of monomeric units selected from the group consisting of propylene, 1-butene, 2-butene, 1,3-butadiene, and mixtures thereof.

24. The pavement of claim 1 wherein the polyolefin is a copolymer of ethylene and propylene.

25. The pavement of claim 1 wherein the fiber is cold drawn.

26. The pavement of claim 1 wherein the fiber is hot drawn.

27. The pavement of claim 1 wherein the staple fiber has a length of between about 5 and 25 min.

28. The pavement of claim 1 having a size of 1–30 dpf.

29. The pavement of claim 12 wherein the staple fiber has a length of between about 5 and 25 mm. and a size of 1–30 dpf. and the pavement is a concrete further comprising an aggregate material.

30. A method of making an improved hot-mix pavement for producing or repairing a geoway, comprising:

providing a hot-mix pavement;

providing staple fibers comprising an alloy of (i) a polyolefin selected from the group consisting of polyethylene, polypropylene, and copolymers thereof and (ii) a polyarylate; and admixing said staple fibers into said hot-mix pavement.

31. The method of claim 30, wherein 0.01–5 wt. % of said fibers are admixed into the pavement.

* * * * *

UNITED STATES PATENT AND TRADEMARK OFFICE

CERTIFICATE OF CORRECTION

PATENT NO. : 5,564,856

DATED : October 15, 1996

INVENTOR(S) : James P. Modrak

It is certified that error appears in the above-indentified patent and that said Letters Patent is hereby corrected as shown below:

Column 12:

Claim 28, line 1, insert --said fibers-- before "having", and replace "size" with --denier--.

Claim 29, line 2, replace "." with --,--, and line 2 replace "size" with --denier--.

Signed and Sealed this

Thirty-first Day of December, 1996

*Attest:*

*Attesting Officer*

BRUCE LEHMAN

*Commissioner of Patents and Trademarks*